US006834568B2

(12) United States Patent
Khubani

(10) Patent No.: US 6,834,568 B2
(45) Date of Patent: Dec. 28, 2004

(54) STRAP WRENCH

(75) Inventor: Anand V. Khubani, Montville, NJ (US)

(73) Assignee: Ideavillage Products Corp., Fairfield, NJ (US)

( * ) Notice: Subject to any disclaimer, the term of this patent is extended or adjusted under 35 U.S.C. 154(b) by 44 days.

(21) Appl. No.: 10/366,000

(22) Filed: Feb. 13, 2003

(65) Prior Publication Data

US 2003/0126959 A1 Jul. 10, 2003

Related U.S. Application Data

(63) Continuation-in-part of application No. 10/034,469, filed on Dec. 28, 2001, now abandoned.

(51) Int. Cl.[7] ..... B25B 13/52
(52) U.S. Cl. ..... 81/64; 81/3.43
(58) Field of Search ..... 81/3.43, 64

(56) References Cited

U.S. PATENT DOCUMENTS

| | | | | |
|---|---|---|---|---|
| 409,148 | A | 8/1889 | Haller | |
| 714,610 | A | 11/1902 | Rawe | |
| 799,155 | A | 9/1905 | Gill et al. | |
| 840,496 | A | 1/1907 | Justen | |
| 876,469 | A | 1/1908 | Martin | |
| 1,071,457 | A | 8/1913 | Old | |
| 1,309,399 | A | 7/1919 | Durham | |
| 1,422,302 | A | 7/1922 | Parker | |
| 1,456,126 | A | 5/1923 | Friday | |
| 1,646,661 | A | 10/1927 | Richard | |
| 1,726,978 | A | 9/1929 | Claybrook | |
| 1,898,409 | A | 2/1933 | Underwood | |
| 1,911,815 | A | 5/1933 | Deringer et al. | |
| 1,916,554 | A | 7/1933 | Bevington et al. | |
| 1,953,238 | A * | 4/1934 | Kosanovich | 81/3.43 |
| 2,004,830 | A | 6/1935 | Rector | |
| 2,057,949 | A | 10/1936 | Hodson | |
| 2,081,383 | A | 5/1937 | Rector | |
| 2,122,104 | A | 6/1938 | Martin | |
| 2,128,991 | A | 9/1938 | Eighmey | |
| 2,132,207 | A | 10/1938 | Donovan | |
| 2,181,012 | A | 11/1939 | Bunting | |
| 2,232,882 | A | 2/1941 | Martino | |
| 2,481,055 | A | 9/1949 | Whitaker | |
| 2,547,748 | A | 4/1951 | Freer | |
| 2,557,601 | A | 6/1951 | Hebden, Jr. | |
| 2,960,896 | A | 11/1960 | Long | |
| 3,584,525 | A | 6/1971 | Caveney et al. | |
| 4,007,650 | A | 2/1977 | Wellman | |
| 4,082,016 | A | 4/1978 | Vonusa | |
| 4,145,938 | A | 3/1979 | Laird, Jr. | |
| 4,150,592 | A | 4/1979 | Mott | |
| 4,345,494 | A | 8/1982 | Aamodt | |
| 4,532,833 | A | 8/1985 | Downs | |
| 4,987,804 | A | 1/1991 | Greenawalt | |
| 5,056,383 | A * | 10/1991 | Halpin | 81/3.43 |
| D369,076 | S | 4/1996 | Alexander | |
| 5,522,284 | A | 6/1996 | Säde | |
| 6,125,723 | A | 10/2000 | Huang | |
| 6,427,561 | B1 | 8/2002 | Huang | |
| 6,520,052 | B1 * | 2/2003 | Saunders et al. | 81/64 |
| 2003/0177873 | A1 * | 9/2003 | Johnson | 81/64 |

FOREIGN PATENT DOCUMENTS

| | | |
|---|---|---|
| GB | 2 161 408 A | 1/1986 |

* cited by examiner

*Primary Examiner*—James G. Smith
(74) *Attorney, Agent, or Firm*—Epstein Drangel Bazerman & James, LLP

(57) ABSTRACT

A strap wrench comprising a handle with a central channel and detachable strap anchored at one end of the handle. The strap is held in place in a channel by means of a rocker arm which is biased to press the strap against a portion the strap positioned in the channel. The strap is initially positioned in the channel by the user pressing one side of the rocker arm to open the channel. Once the strap is initially seated, the rocker arm may be released and the loop may be further tightened by pulling the strap through the channel. Free movement of the strap may be enhanced by applying pressure to the rocker arm.

2 Claims, 7 Drawing Sheets

STRAP WRENCH

This application is a continuation-in-part of U.S. patent application Ser. No. 10/034,469, filed Dec. 28, 2001 now abandoned.

BACKGROUND OF THE INVENTION

1. Field of the Invention

The invention relates to driving devices for use with tubular members and more particularly to an improved strap wrench.

2. Description of the Prior Art

Strap wrenches have been in existence for over 100 years to drive tubular members. Strap wrenches use a flexible strap positioned and tightened around the tubular member to transmit a turning force to the tubular member. These devices usually consist of a strap loop anchored at one end to a handle. Its other end is connected to a clamping means on or in the handle to draw the strap tightly around the tubular member to allow the application of torque through the strap to the tubular member.

Strap wrenches may be used for many different applications. Since engine oil filters are of such a large diameter that they can not be turned with most traditional wrenches, a strap wrench is the ideal tool for removing and replacing the filter. Equally, water and gas pipes are usually located in areas where there is very little room to work. A properly designed strap wrench is capable of turning pipes in restricted areas where traditional wrenches, such as monkey wrenches, are not capable of functioning. Similarly, strap wrenches may be used to open and close jars or bottles.

While the concept of the use of a strap for such purposes has been known for a number of years, the method of construction of strap wrenches has markedly varied over time with developments in materials and construction techniques as can be seen in the following: U.S. Pat. No. 1,525,358 issued to Bergen on Feb. 3, 1925; U.S. Pat. No. 1,916,554 issued to Bevington et al. on Jul. 4, 1933; U.S. Pat. No. 2,004,830 issued to Rector on Jun. 11, 1935; U.S. Pat. No. 2,081,383 issued to Rector on May 25, 1937; U.S. Pat. No. 2,128,991 issued to Eighmey on Sep. 6, 1938; U.S. Pat. No. 2,232,882 issued to Martino on Feb. 25, 1941; U.S. Pat. No. 2,481,055 issued to Whitaker on Sep. 6, 1949; U.S. Pat. No. 2,557,601 issued to Hebden on Jun. 19, 1951; U.S. Pat No. 2,960,896 issued to Long on Nov. 22, 1960; U.S. Pat. No. 4,145,938 issued to Laird, Jr. on Mar. 27, 1979; and U.S. Pat. No. 4,345,494 issued to Aamodt on Aug. 24, 1982.

U.S. Pat. No. 4,532,833 issued to Downs on Aug. 6, 1985 discloses a strap wrench which has both ends of the strap anchored in a slot in the center of the handle. The device contains an adjustable slide member which controls the size of the loop formed by the strap. Such a device limits the use of the device when the end of the tubular member is not accessible.

U.S. Pat. No. 6,125,723 issued to Huang on Oct. 3, 2000 discloses a strap wrench where one end of the strap is fixed to the handle. The other end of the strap is pulled through a channel on the handle and is locked into place by a pivotally mounted toothed cam which is positioned by the user against the strap. This, in conjunction with a pawl on the handle, holds the strap tightly in place and transmits force from the handle through the strap to the tubular member. The engagement of the cam with the strap requires the user to actively engage in pressuring the cam in position and the cam teeth into the strap.

SUMMARY OF THE PRESENT INVENTION

It is an object of the present invention to allow tightening of the strap of a strap wrench in accordance with the present invention around the tubular member without applying pressure to the rocker arm.

It is also an object of the present invention to create a strap wrench where the strap is automatically locked in position.

It is also a further object of the present invention to create a strap wrench with allows the user to release the strap by simply applying pressure to a rocker arm on the handle of the wrench It is a further object of the invention which allows the user to change the strap when necessary due to wear on the strap or for use with different sized pipes, oil filters, jars and the like.

It is an additional object of the present invention to creating a strap wrench which reduces the wear on the strap.

The present invention is a strap wrench comprising a handle and detachable strap. The handle has an enlarged opening for receiving and holding one end of the strap. One end of the strap is enlarged and shaped to be received in said enlarged opening in the handle. While removable, when the enlarged end of the strap is so placed in the enlarged opening in the handle, the strap is anchored at that end The handle has a lengthwise channel passing through it through which the other end of the strap passes. The strap is held in place in the channel by means of a rocker arm which is biased by a spring to press the strap against the far wall of the channel when the strap is positioned in the channel. The surface of the rocker arm which engages the strap has a means for frictionally engaging the strap such as grooves, teeth, roughened surface or a layer of high friction material such as a rubber pad. In addition or as a alterative, the surface of the channel opposite the point of contact of the rocker arm may have a similar friction means for engaging the strap when the strap is pressed against it.

When the strap is drawn through the channel, the strap creates a loop above the top of the handle for placement around the tubular member which requires turning. The strap is initially positioned in the channel by the user pressing one side of the rocker arm to release and open the channel. Once the strap is initially seated, the rocker arm may be released and the loop may be tightened by pulling the strap through the channel since this will act to move the contact between the strap and the rocker arm to a portion of the rocker arm without a friction means. Once the rocker arm is released, the loop may only be enlarged by applying pressure to one side of the rocker arm. Free movement of the strap may also be enhanced by applying pressure to the rocker arm. The strap of the strap wrench may have rows of projections on its surface to aid in gripping the tubular object to which torque is to be applied.

Due to the flexibility of the strap, the strap wrench may also be used on non-circular tubular objects. Further uses and advantages will become apparent from the detailed description of the preferred embodiment.

DESCRIPTION OF THE PREFERRED EMBODIMENT

Figure 1:
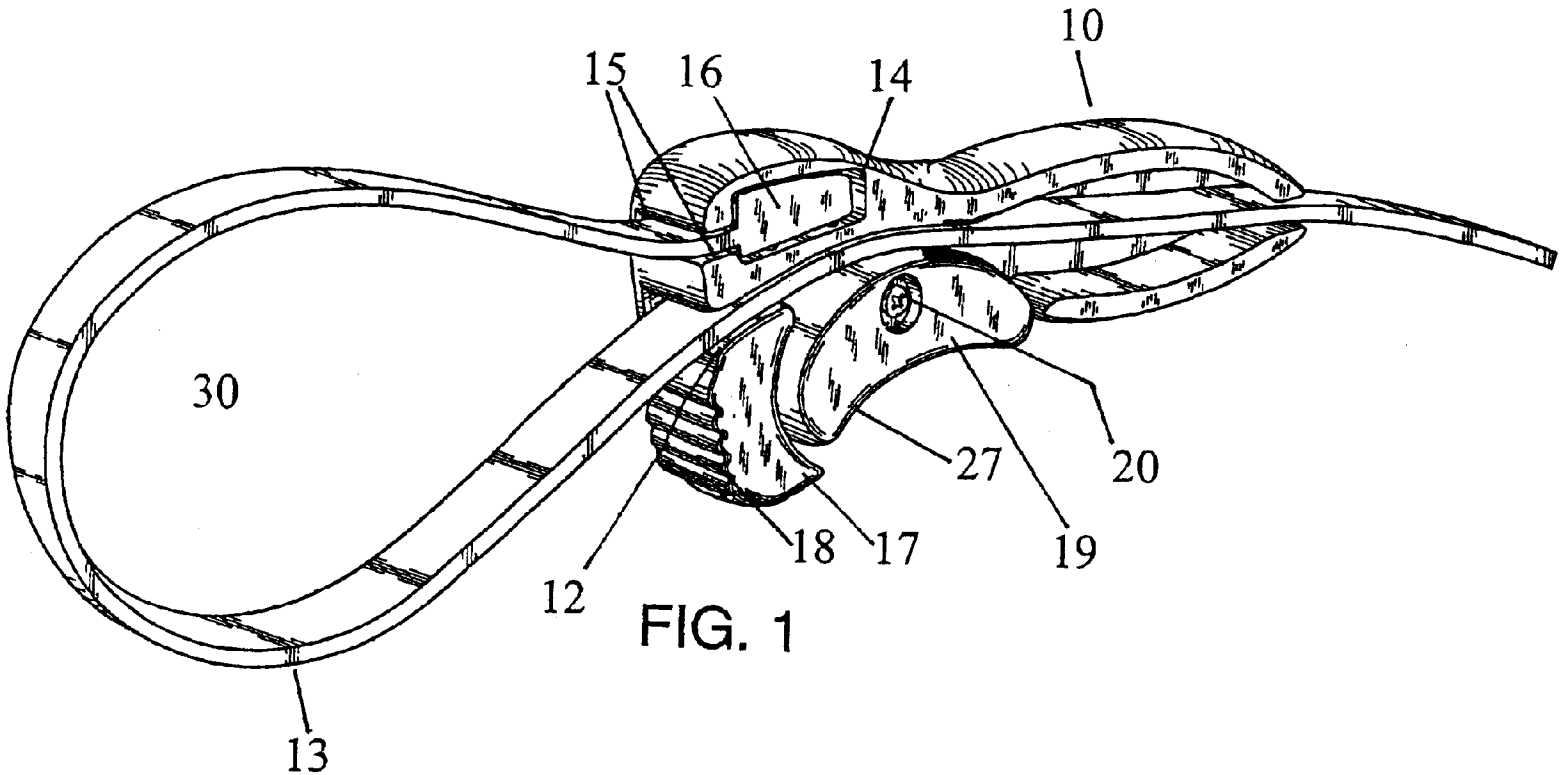
FIG. 1 is a perspective view of a strap wrench in accordance with the present invention.
Figure 2:
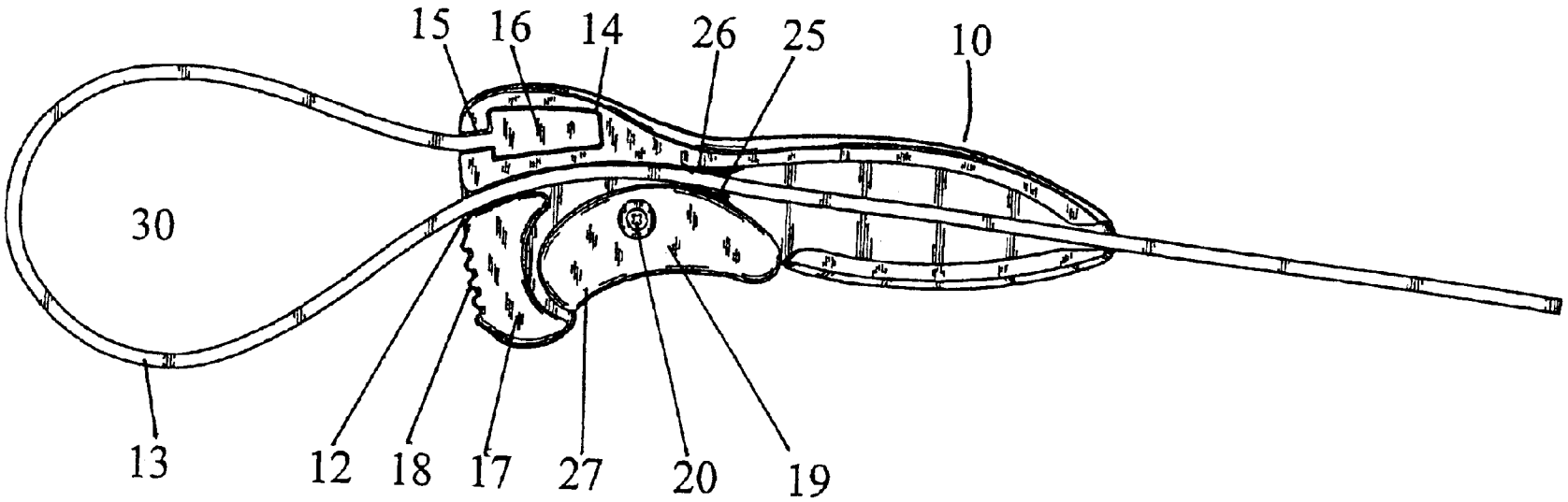
FIG. 2 is a front view of a strap wrench in accordance with the present invention.
Figure 3:
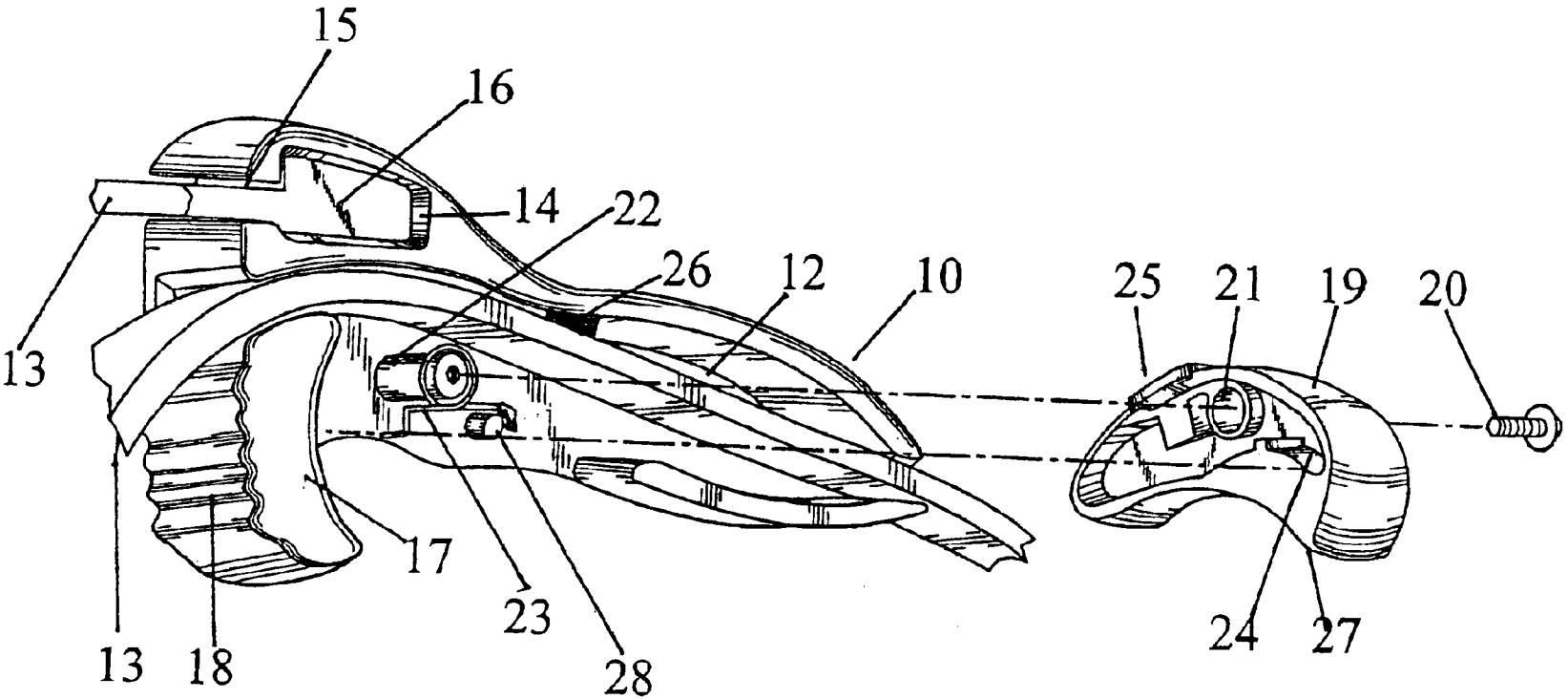
FIG. 3 is an exploded perspective view of a strap wrench in accordance with the present invention.
Figure 4:
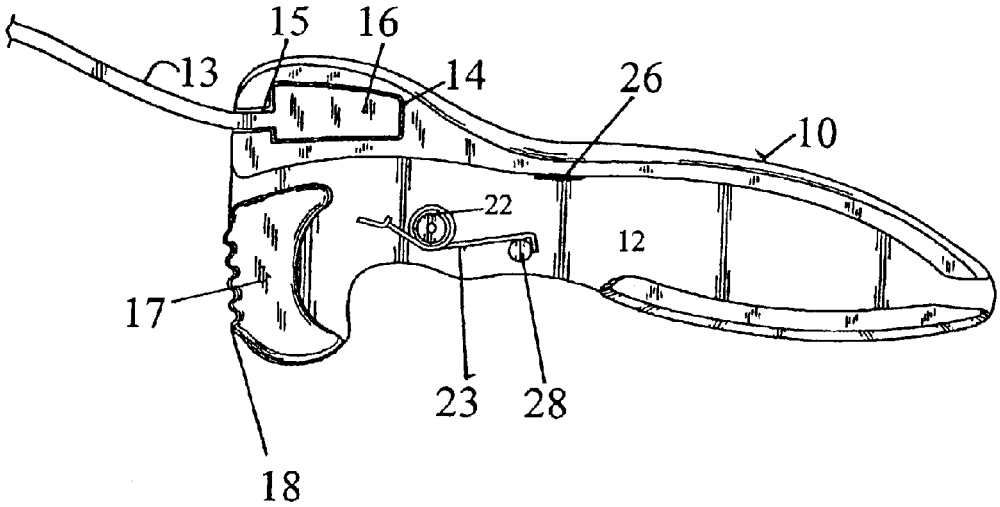
FIG. 4 is a front view of the of the handle of the present invention with the rocker arm removed but showing the rocker arm biasing means
Figure 5:
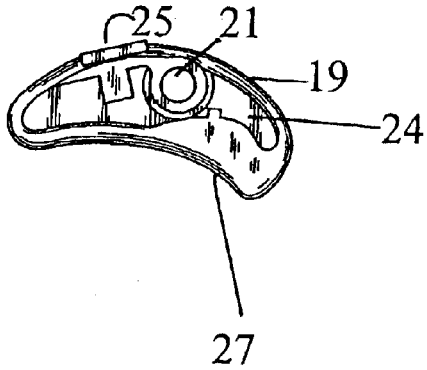
FIG. 5 is a back view of the rocker arm.

Referring to FIG. 1–8, a driving device in accordance with the present invention is shown for driving tubular members. It comprises a handle 10 having a longitudinal opening or channel 12 passing through its entire length proportioned as to receive a strap 13. In one end of the handle 10 is an enlarged cavity 14 in communication with a slit 15. Slit 15 forms an open passage between the enlarged cavity 14 and the exterior of the handle 10. Strap 13 has an enlarged end 16 positioned within cavity 14. The portion of strap 13 adjacent the enlarged end 16 passes through slit 15. This arrangement anchors the enlarged end 16 of strap 13 in the handle 10, but allows replacement of the strap to replace a worn strap or to use straps at different length.

In use the other end of strap 13 passes through channel 12 in the handle 10, thereby forming a loop 30 for engaging a tubular member (not shown) which is to be driven by the strap wrench. The handle 10 both holds the strap 13 in place after the loop 30 is sized to tightly fit around the tubular member and to transmit the turning force from the handle 10 to the tubular member. The handle 10 has a fixed pawl 17 positioned on the opposite side of the channel 12 from cavity 14 and thus the enlarged end 16 of strap 13. Pawl 17 has teeth 18 designed to engage strap 13 on the opposite side of channel 12. As will be more fully discussed hereinafter, the pawl 17 is the primary means by which a turning energy is transmitted from the handle 10 to the strap 13 and then through the strap 13 to the tubular member to be driven.

The strap 13 is held in position by means of rocker arm 19. Rocker arm 19 is held in place and pivoted around screw 20. Screw 20 passes through opening 21 in rocker arm 19 and screws into post 22 which forms part of the handle 10. Torsion spring 23 is looped around and held in position by post 22. One end of the torsion spring 23 is held against downward movement by post 28. The other end of the torsion spring 23 is bent at right angles to the remainder of the spring 23 so as to allow it to be positioned in a cavity 24 in rocker arm 19. This biases the rocker arm 19 into engagement with the far wall of channel 12. Alternatively a coil spring with one end in engagement with the handle 10 and the other end in engagement with the cavity 24 of rocker arm 19 or other equivalent biasing means may be used.

Figure 6:
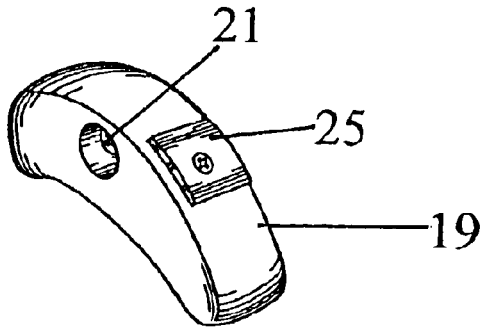
FIG. 6 is a prospective view of the rocker arm.
Figure 7:
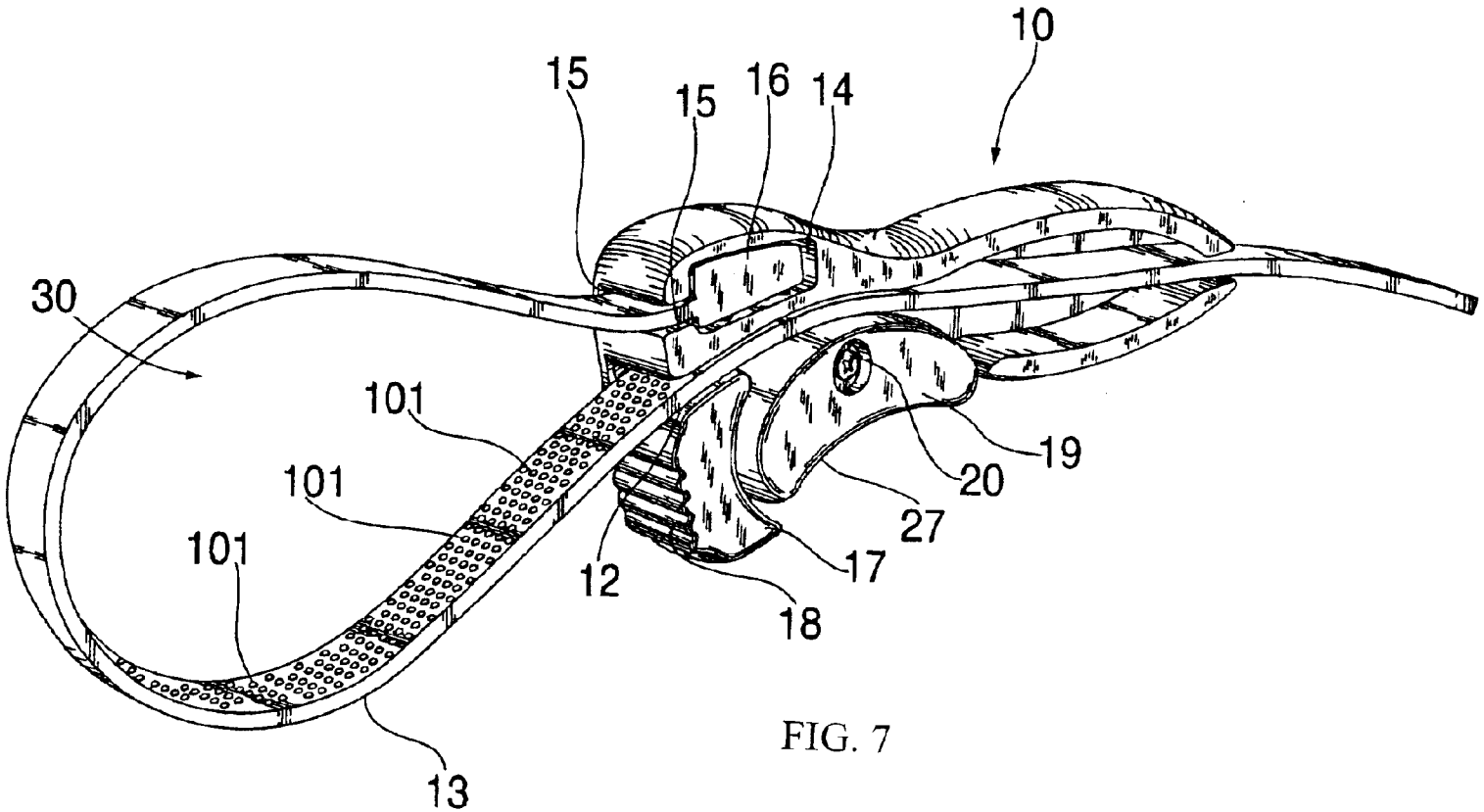
FIG. 7 is a perspective view of a second embodiment of the patent invention in which the strap has projection on one surface.
Figure 8:
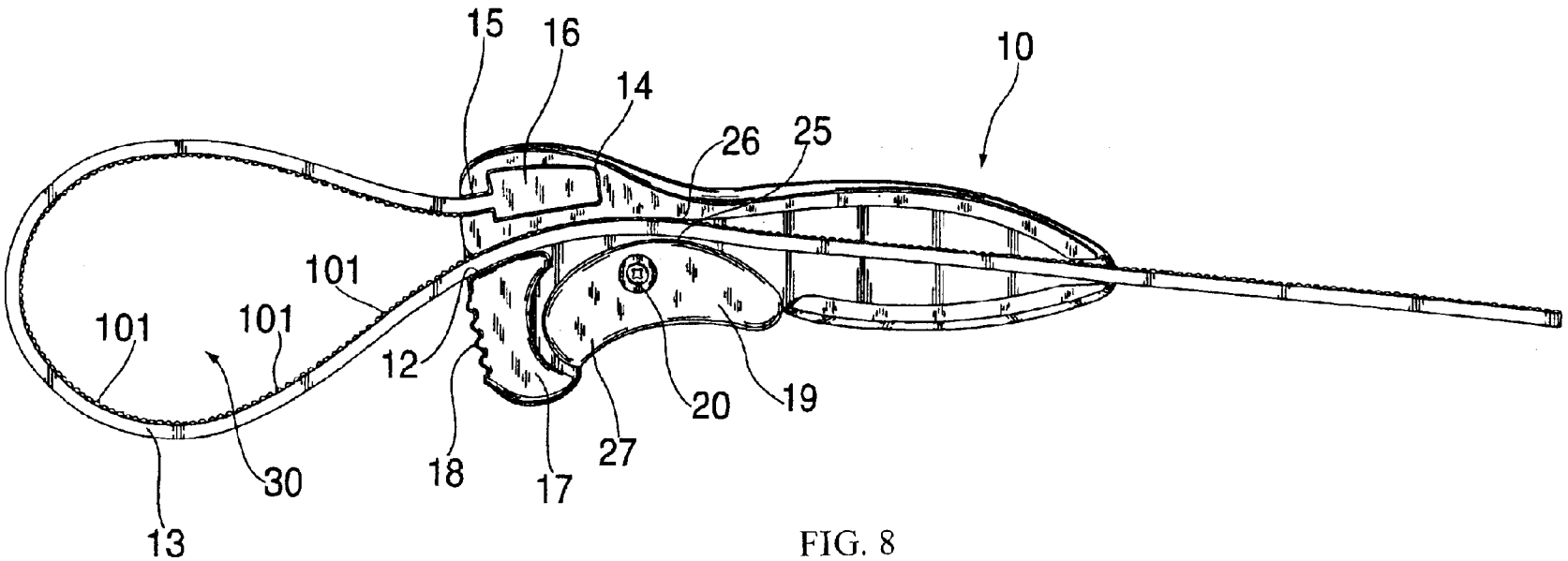
FIG. 8 is a side view of the embodiment of FIG. 7.

The biasing spring 23 biases the rocker arm 19 into engagement with the strap 13 holding it in place. The engagement between rocker arm 19 and strap 13 maybe enhanced by having a friction means 25 either forming part of or being attached to the rocker arm 19 at its area of contact with the strap 13. This friction means 25 may consist of a roughen surface, teeth, groves, or bumps in the surface of rocker arm 19 opposite where the rocker arm 19 comes into engagement with the strap 13. Equally as shown in FIG. 6, it may be an addition of a high friction material, fabric or coating such as a rubber pad 25 shown attached to rocker arm 19 by any suitable means such as a screw. In addition or alternatively a similar friction means 26 may be placed on the opposite interior wall of channel 12, thereby increasing the frictional engagement and assuring that the strap 13 once position positioned will maintain the desired loop 30 size.

In operation, the enlarged end 16 of strap 13 is positioned in cavity 14 so as to fix that end of the strap 13. The other end of the strap 13 is then passed around the tubular member to be driven and then through channel 12. The user raises rocker arm 19 by pressing against the front end 27 of rocker arm 19 allowing the strap 13 to be pulled into and through channel 12. Since the friction means 25 is being held away from the strap 13 the strap 13 easily passes through the channel 12 allowing the strap 13 to be tightly positioned around the tubular member to be driven. Upon release of rocker arm 19, the friction means 25 is positioned against strap 13 and thus against the far wall of channel 12. Given the positioning of friction means 25 and if added, friction means 26, the strap 13 may be further tightened around the tubular member after release of the rocker arm 19 by pulling on the free end of strap 13. In doing so the area of contact between the strap 13 and the rocker arm 19 is shifted away from the friction means 25 & 26. However, the loop 30 formed by strap 13 can only be enlarged by applying pressure to area 27 of rocker arm 19.

The user must apply pressure to the handle 10 in the direction that brings pawl 17 against strap 13 and thus allows transmission of forces from the handle 10 through the strap 13 to the member. If it is desired to drive the tubular member in the opposite direction, the handle 10 is simply turned over and re-engaged so that the pawl 17 will engage the strap 13 when the handle 10 is driven in the desired direction.

As a second embodiment of the present invention, the strap 13 has positioned there on a series of rows of projections 101. Each row 101 is offset from the rows on either side. The projections 101 act as an aide in gripping the object to be turned by the grip wrench 10. When the strap is tightened, they compress against the surface of the object to be turned, adding a fractional element and to the extent the surface is irregular, catches on the regular portions of the surface. This adds materially to the gripping power of the strap against the surface to be turned.

It is understood that the present embodiment described above is to be considered as illustrative and not restrictive. It will be obvious to those skilled in the art to make various changes, alterations and modifications to the invention described herein. To the extent that these variations, modifications and alterations depart from the scope and spirit of the appended claims, they are intended to be encompassed therein.

I claim:

1. A strap wrench for engaging and for driving an object, said device comprising:

a handle including a first end and a second end, and including a channel formed therein, a strap, one end of which is removably secured to said first end of said handle, said strap being slidably received in said channel in said handle so that the strap may loop around the first end of the handle, said strap having projections on the inner surface for engaging the object to be driven by the strap wrench, and means for automatically securing said strap in said handle so that the strap may be moved to make the loop formed by the strap smaller without adjusting the securing means, wherein the projections on the strap are formed in rows and each row is offset from the two rows surrounding it.

2. The driving device according to claim 1 wherein said strap has longitudinal edges and each row is at right angles to the longitudinal edges of the strap.

* * * * *